US007114356B1

(12) United States Patent
Yu

(10) Patent No.: US 7,114,356 B1
(45) Date of Patent: Oct. 3, 2006

(54) PADLOCK THAT CAN CONTROL OPERATION OF LOCKING HOOK

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 11/211,946

(22) Filed: Aug. 26, 2005

(30) Foreign Application Priority Data

Mar. 30, 2005 (TW) ..... 94204965 U

(51) Int. Cl.
*E05B 37/02* (2006.01)

(52) U.S. Cl. ..... 70/21; 70/25

(58) Field of Classification Search ..... 70/21, 70/22, 25, 26, 29, 38 A, 284, 285, 51, 52, 70/46, 54–56, 38 R, 38 B, DIG. 63, DIG. 71
See application file for complete search history.

(56) References Cited

U.S. PATENT DOCUMENTS 6,848,283 B1 * 2/2005 Lin ..... 70/21
2002/0088256 A1 * 7/2002 Taylor et al. ..... 70/25
2004/0226323 A1 * 11/2004 Ling et al. ..... 70/25
2004/0226324 A1 * 11/2004 Loughlin et al. ..... 70/25
2005/0092036 A1 * 5/2005 Lai ..... 70/25
2005/0126233 A1 * 6/2005 Yu ..... 70/25
2005/0132762 A1 * 6/2005 Yu ..... 70/25
2005/0262902 A1 * 12/2005 Ling et al. ..... 70/21

* cited by examiner

*Primary Examiner*—Lloyd A. Gall
(74) *Attorney, Agent, or Firm*—Rosenberg, Klein & Lee

(57) ABSTRACT

A padlock includes a housing, a locking hook, a number lock core unit, a locking barrel, and a locking member. When the locking end of the locking hook is located at the closed position, the locking member is driven by the locking barrel to move to a first position where the opening of the insertion recess of the locking member is closed by the protrusion of the housing and a second position where the opening of the insertion recess of the locking member is opened by the protrusion of the housing. Thus, the padlock that can limit or open an end of a locking hook to close or open the locking hook.

7 Claims, 5 Drawing Sheets

PADLOCK THAT CAN CONTROL OPERATION OF LOCKING HOOK

BACKGROUND OF THE INVENTION

1. Field of the Invention

The present invention relates to a padlock, and more particularly to a padlock that can control operation of a locking hook so as to open or close the locking hook.

2. Description of the Related Art

A conventional padlock comprises a housing, a locking hook mounted on the housing and having a connecting end and a locking end, a locking barrel mounted in the housing and rotatable by a specific key, and a locking member mounted on the housing and driven by the locking barrel. The locking member has a top face formed with an insertion recess having an opening. Thus, when the locking end of the locking hook is located at the closed position, the locking member is driven by the locking barrel to move to a first position where the opening of the insertion recess of the locking member faces the connecting end of the locking hook so that the locking end of the locking hook is limited in the insertion recess of the locking member, thereby forming a locked state, and a second position where the opening of the insertion recess of the locking member faces the side face of the housing, so that the insertion recess of the locking member is opened and the locking end of the locking hook can be rotated to detach from the insertion recess of the locking member, thereby forming an unlocked state. However, the insertion recess of the locking member is opened and has a determined depth after the locking end of the locking hook is limited in the insertion recess of the locking member, so that a person can insert an unlocking tool from the opening into the insertion recess of the locking member to rotate the locking member so as to unlock the locking end of the locking hook forcibly, thereby releasing the locking effect of the padlock.

The closest prior art of which the applicant is aware is disclosed in U.S. patent application Ser. No. 2004/0226324-A1.

SUMMARY OF THE INVENTION

The present invention is to mitigate and/or obviate the disadvantage of the conventional padlock.

The primary objective of the present invention is to provide a padlock that can limit or open an end of a locking hook to close or open the locking hook.

Another objective of the present invention is to provide a padlock, wherein when the padlock is disposed at the locked state, the opening of the insertion recess of the locking member is closed by the protrusion of the housing, so that a person cannot insert an unlocking tool from the opening into the insertion recess of the locking member to rotate the locking member by the stopping effect of the protrusion of the housing, thereby preventing the locking member from being rotated forcibly by the unlocking tool so as to provide an anti-theft effect.

In accordance with the present invention, there is provided a padlock, comprising:

a housing having a protrusion;

a locking hook having a connecting end and a locking end, wherein the connecting end of the locking hook is extended into the housing and axially movable in the housing, and the locking end of the locking hook is rotatable about the connecting end of the locking hook to an opened position and a closed position;

a locking barrel that is rotatable by a specific key;

a locking member driven by the locking barrel and having an insertion recess and a slide slot, wherein the insertion recess of the locking member is extended from a top face toward a periphery of the locking member to form an opening, the slide slot of the locking member is extended from the opening of the insertion recess of the locking member to the bottom thereof and extended through a length along the periphery of the locking member, the protrusion of the housing is mounted in the slide slot of the locking member so that when the locking end of the locking hook is located at the closed position, the locking member is driven by the locking barrel to move to a first position where the opening of the insertion recess of the locking member is closed by the protrusion of the housing and a second position where the opening of the insertion recess of the locking member is opened by the protrusion of the housing.

Further benefits and advantages of the present invention will become apparent after a careful reading of the detailed description with appropriate reference to the accompanying drawings.

DETAILED DESCRIPTION OF THE INVENTION

Figure 2:
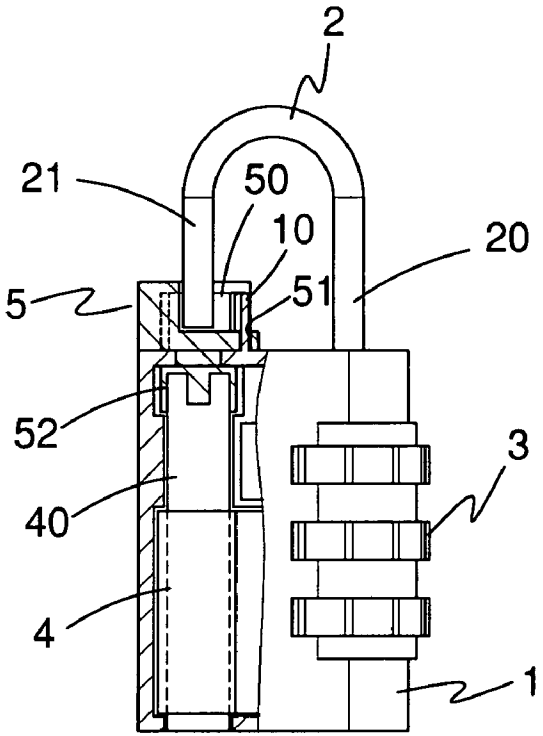
FIG. 2 is a plan cross-sectional assembly view of the padlock as shown in FIG. 1.
Figure 1:
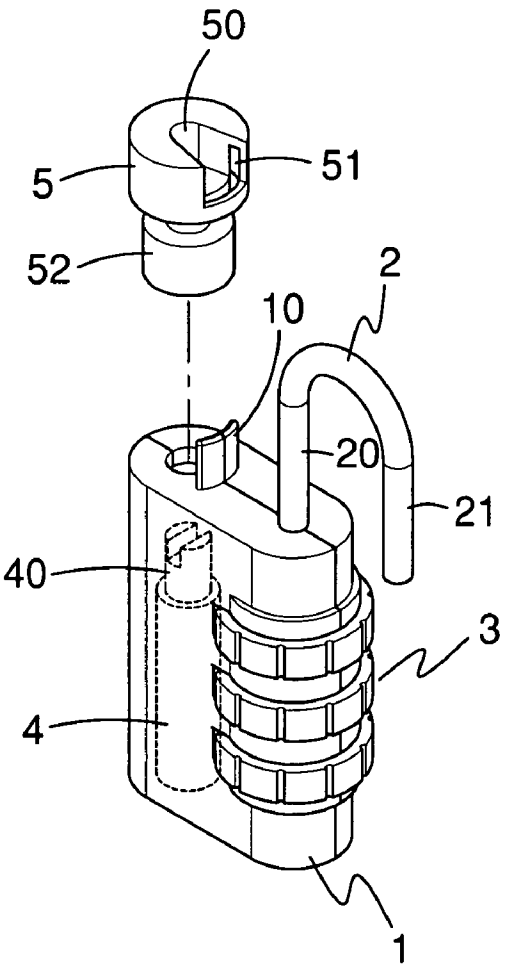
FIG. 1 is an exploded perspective view of a padlock in accordance with the preferred embodiment of the present invention.

Referring to the drawings and initially to FIGS. 1 and 2, a padlock in accordance with the preferred embodiment of the present invention comprises a housing 1, a locking hook 2, a number lock core unit 3, a locking barrel 4, and a locking member 5.

The housing 1 has a top face formed with a protrusion 10.

The locking hook 2 is mounted on the housing 1. The locking hook 2 is a substantially U-shaped rod and has a connecting end 20 and a locking end 21. The connecting end 20 of the locking hook 2 is extended into the housing 1 and axially movable in the housing 1. The locking end 21 of the locking hook 2 is rotatable about the connecting end 20 of the locking hook 2 to an opened position and a closed position.

The number lock core unit 3 is mounted in the housing 1. The connecting end 20 of the locking hook 2 is received in the number lock core unit 3. Thus, the connecting end 20 of the locking hook 2 is axially movable in the housing 1 when the number lock core unit 3 is disposed at an unlocked state and is locked when the number lock core unit 3 is disposed at a locked state so as to lock and unlock the locking hook 2.

The locking barrel 4 is mounted in the housing 1. The locking barrel 4 has a drive shaft 40 that is rotatable by a specific key.

The locking member 5 is mounted on the housing 1. The locking member 5 has an insertion recess 50, a slide slot 51 and a connecting portion 52. The insertion recess 50 of the locking member 5 is extended from a top face toward a periphery of the locking member 5 to form an opening. The slide slot 51 of the locking member 5 is extended from the opening of the insertion recess 50 of the locking member 5 to the bottom thereof and extended through a length along the periphery of the locking member 5. Thus, the protrusion 10 of the housing 1 is mounted in the slide slot 51 of the locking member 5 to close the opening of the insertion recess 50 of the locking member 5. Alternatively, the protrusion 10 of the housing 1 is movable in the slide slot 51 of the locking member 5 to open the opening of the insertion recess 50 of the locking member 5. In addition, the slide slot 51 of the locking member 5 has a portion which is spaced from the opening of the insertion recess 50 and not extended through the top face of the locking member 5. The connecting portion 52 of the locking member 5 is located at the bottom of the locking member 5 and secured to the drive shaft 40 of the locking barrel 4 so that the locking member 5 is driven to rotate by the drive shaft 40 of the locking barrel 4. Alternatively, the drive shaft 40 of the locking barrel 4 is integrally formed with the locking member 5.

Figure 4:
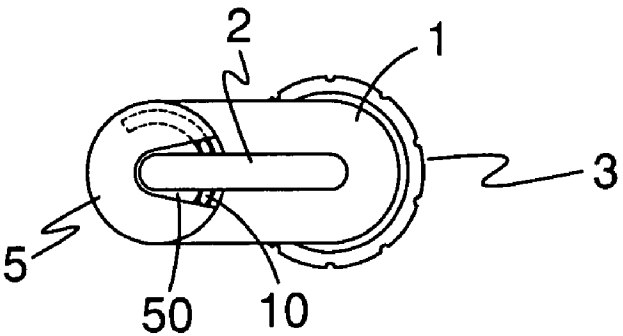
FIG. 4 is a top plan view of the padlock as shown in FIG. 3.
Figure 3:
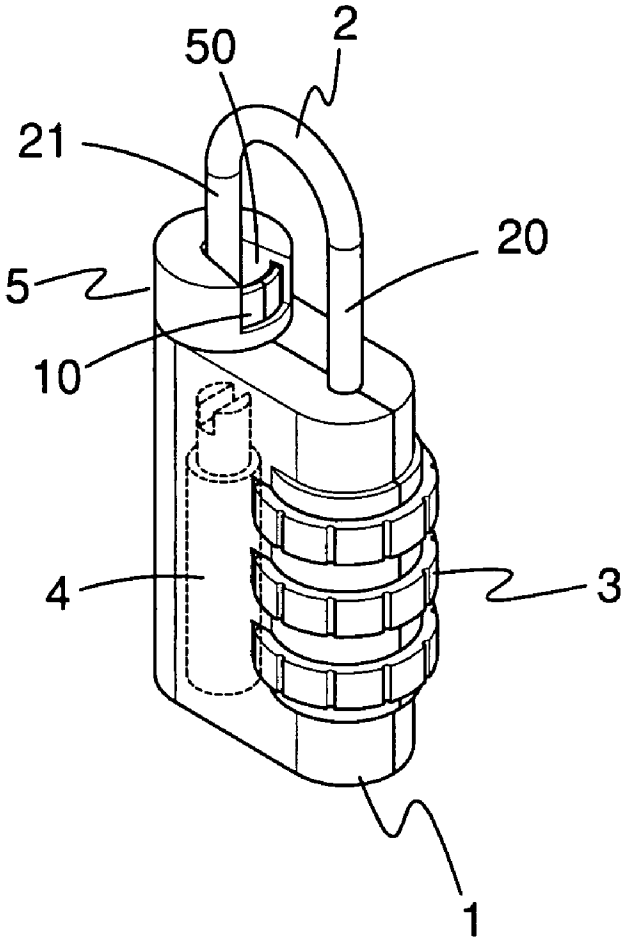
FIG. 3 is a perspective assembly view of the padlock as shown in FIG. 1.

Referring to FIGS. 3 and 4, the locking end 21 of the locking hook 2 is located at the closed position, and the number lock core unit 3 is disposed at the locked state. At this time, the locking barrel 4 is not rotated by a specific key, so that the connecting end 20 of the locking hook 2 is not axially movable in the housing 1, and the locking end 21 of the locking hook 2 is limited in the insertion recess 50 of the locking member 5. In addition, the opening of the insertion recess 50 of the locking member 5 is closed by the protrusion 10 of the housing 1, so that the locking end 21 of the locking hook 2 cannot be rotated about the connecting end 20 of the locking hook 2 to the opened position, thereby locking the locking hook 2.

Figure 5:
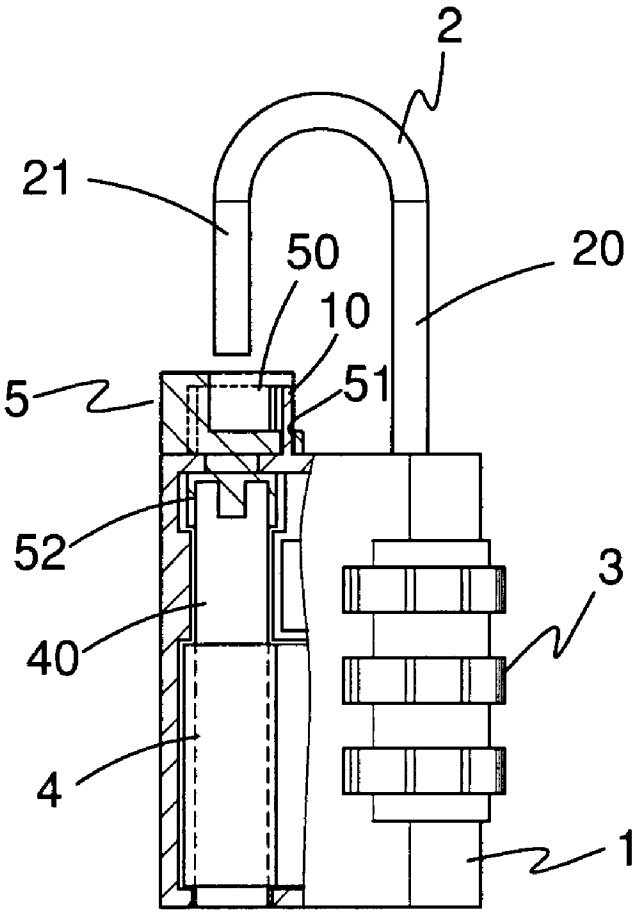
FIG. 5 is a schematic operational view of the padlock as shown in FIG. 2.

Referring to FIG. 5, when the number lock core unit 3 is disposed at the unlocked state, the connecting end 20 of the locking hook 2 is axially movable upward in the housing 1, so that the locking end 21 of the locking hook 2 is lifted to detach from the insertion recess 50 of the locking member 5. Thus, the locking end 21 of the locking hook 2 can be rotated about the connecting end 20 of the locking hook 2 to the opened position, thereby unlocking the locking hook 2.

Figure 7:
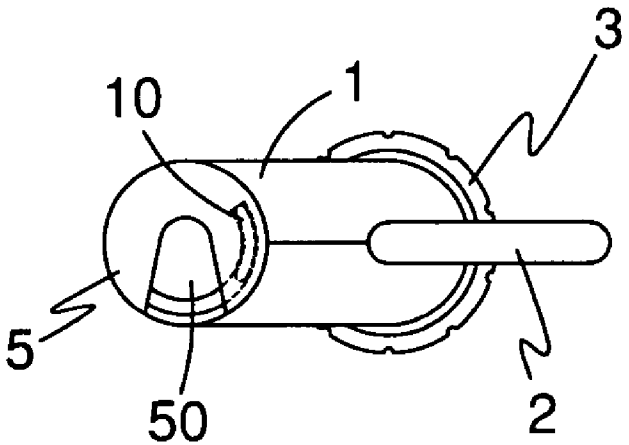
FIG. 7 is a top plan view of the padlock as shown in FIG. 6.
Figure 6:
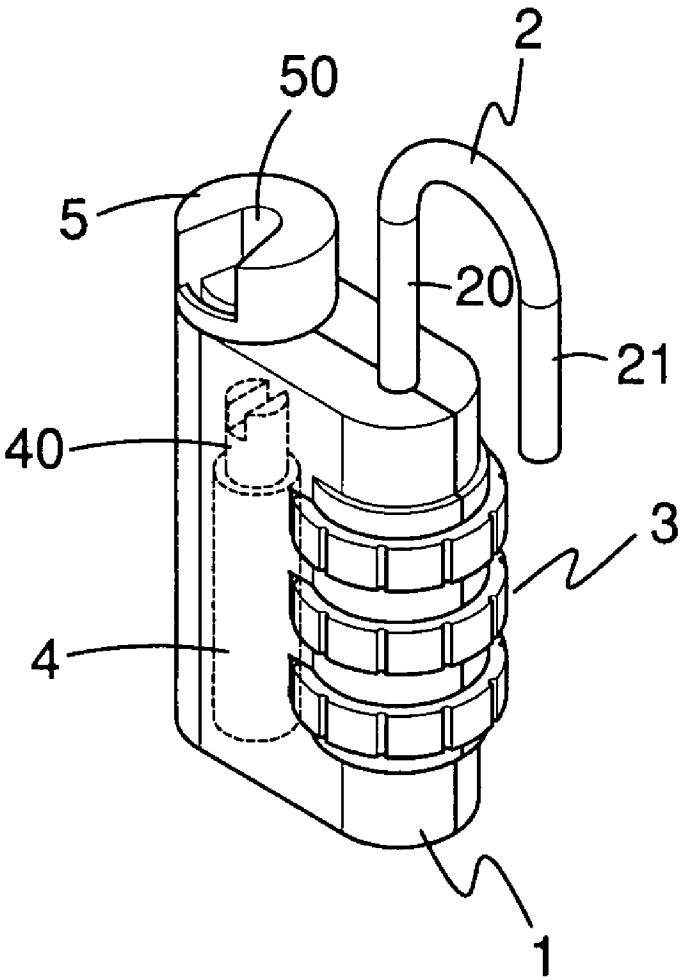
FIG. 6 is a schematic operational view of the padlock as shown in FIG. 3.

Referring to FIGS. 6 and 7, the connecting end 20 of the locking hook 2 is located at the closed position, and the number lock core unit 3 is disposed at the locked state so that the connecting end 20 of the locking hook 2 is not axially movable in the housing 1. At this time, the locking barrel 4 is rotated by a specific key to drive the locking member 5 to rotate through a determined angle, so that the opening of the insertion recess 50 faces the side face of the housing 1, thereby separate the opening of the insertion recess 50 from the protrusion 10 of the housing 1. In such a manner, the locking end 21 of the locking hook 2 can be rotated about the connecting end 20 of the locking hook 2 and can be moved from the opening of the insertion recess 50 toward the side face of the housing 1 to the opened position, thereby unlocking the locking hook 2.

Accordingly, when the padlock is disposed at the locked state, the opening of the insertion recess 50 of the locking member 5 is closed by the protrusion 10 of the housing 1, so that a person cannot insert an unlocking tool from the opening into the insertion recess 50 of the locking member 5 to rotate the locking member 5 by the stopping effect of the protrusion 10 of the housing 1, thereby preventing the locking member 5 from being rotated forcibly by the unlocking tool so as to provide an anti-theft effect.

Figure 9:
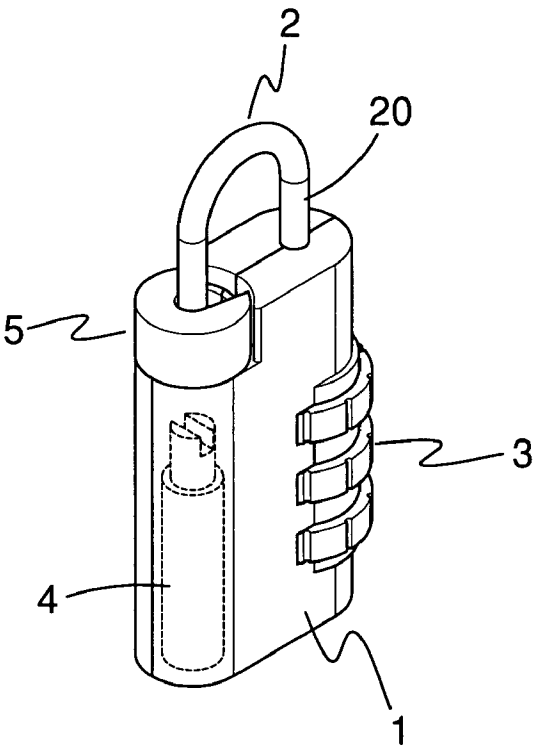
FIG. 9 is a perspective assembly view of the padlock as shown in FIG. 8.
Figure 8:
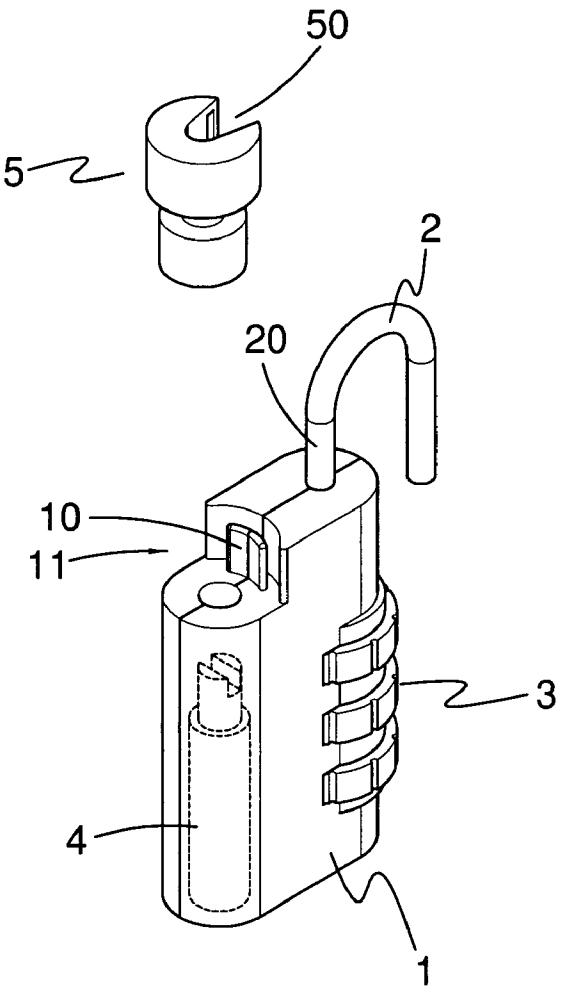
FIG. 8 is an exploded perspective view of a padlock in accordance with another preferred embodiment of the present invention.

Referring to FIGS. 8 and 9, the top face of the housing 1 has a side formed with a recess 11. Thus, the protrusion 10 of the housing 1 is mounted in the recess 11 of the housing 1, and the locking member 5 is sunk into the recess 11 of the housing 1.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A padlock, comprising:

a housing having a protrusion;

a locking hook having a connecting end and a locking end, wherein the connecting end of the locking hook is extended into the housing and axially movable in the housing, and the locking end of the locking hook is rotatable about the connecting end of the locking hook to an opened position and a closed position;

a locking barrel that is rotatable by a specific key;

a locking member driven by the locking barrel and having an insertion recess and a slide slot, wherein the insertion recess of the locking member is extended from a top face toward a periphery of the locking member to form an opening, the slide slot of the locking member is extended from the opening of the insertion recess of the locking member to the bottom thereof and extended through a length along the periphery of the locking member, the protrusion of the housing is mounted in the slide slot of the locking member so that when the locking end of the locking hook is located at the closed position, the locking member is driven by the locking barrel to move to a first position where the opening of the insertion recess of the locking member is closed by the protrusion of the housing and a second position where the opening of the insertion recess of the locking member is opened by the protrusion of the housing.

2. The padlock in accordance with claim 1, further comprising a number lock core unit mounted on the housing and movable between an unlocked state wherein the connecting end of the locking hook is axially movable in the housing and a locked state wherein the connecting end of the locking hook is not axially movable in the housing.

3. The padlock in accordance with claim 1, wherein the locking member is separated from the locking barrel.

4. The padlock in accordance with claim 3, wherein the locking barrel has a drive shaft that is rotatable by the specific key, and the locking member has a connecting portion secured to the drive shaft of the locking barrel so that the locking member is driven to rotate by the drive shaft of the locking barrel.

5. The padlock in accordance with claim 4, wherein the drive shaft of the locking barrel is integrally formed with the locking member.

6. The padlock in accordance with claim 1, wherein the housing has a recess, and the locking member is mounted in the recess of the housing.

7. The padlock in accordance with claim 1, wherein the slide slot of the locking member has a portion which is spaced from the opening of the insertion recess and not extended through the top face of the locking member.

* * * * *